313-414 SR

2/10/87 OR 4,642,515

United States Patent [19]

Say

[11] Patent Number: 4,642,515

[45] **Date of Patent: * Feb. 10, 1987**

[54] COLOR CATHODE RAY TUBE IN-LINE ELECTRON GUN STRUCTURE INCORPORATING DEEP SADDLE ACCELERATING ELECTRODE

[75] Inventor: Donald L. Say, Waterloo, N.Y.

[73] Assignee: North American Philips Consumer Electronics Corp., New York, N.Y.

[ * ] Notice: The portion of the term of this patent subsequent to Sep. 17, 2002 has been disclaimed.

[21] Appl. No.: 680,713

[22] Filed: Dec. 12, 1984

[51] Int. Cl.[4] ..... H01J 29/62

[52] U.S. Cl. ..... 313/414

[58] Field of Search ..... 313/414, 412, 413, 458, 313/460

[56] References Cited

U.S. PATENT DOCUMENTS

| | | | |
|---|---|---|---|
| 4,517,488 | 5/1985 | Say | 313/414 |
| 4,535,266 | 8/1985 | Say | 313/414 |
| 4,542,318 | 9/1985 | Say | 313/414 |

*Primary Examiner*—David K. Moore
*Assistant Examiner*—K. Wieder
*Attorney, Agent, or Firm*—John C. Fox

[57] ABSTRACT

In a color cathode ray tube having an in-line electron gun with overlapping CFF lenses, the accelerating electrode apertures are critically enlarged to deepen the saddles between adjacent apertures in order to balance the asymmetry of the lensing field caused by the forcusing electrode, and eliminate beam spot distortion at the screen due to field asymmetries in the focus region.

4 Claims, 3 Drawing Figures

COLOR CATHODE RAY TUBE IN-LINE ELECTRON GUN STRUCTURE INCORPORATING DEEP SADDLE ACCELERATING ELECTRODE

CROSS-REFERENCE TO RELATED APPLICATIONS

The following U.S. Patents and Patent Applications relate to color cathode ray tube electrodes having tapered apertures: U.S. Pat. No. 4,542,318, filed Feb. 4, 1983, a continuation-in-part of Ser. No. 450,574, filed Dec. 16, 1982, now abandoned; U.S. Pat. No. 4,517,488, filed Apr. 14, 1983; U.S. Pat. No. 4,535,266, filed May 2, 1983; and Ser. No. 681,039, concurrently filed herewith.

The above applications are assigned to the assignee of the present invention.

BACKGROUND OF THE INVENTION

This invention relates to an accelerating electrode for an inline electron gun structure for color cathode ray tubes (CCRT's), in which the apertures are tapered and overlapping; and more particularly relates to such electrode in which the apertures are enlarged for increased overlap; and also relates to gun structures incorporating such electrode.

Reducing the diameter of the necks of CCRT's can lead to cost savings for the television set maker and user in enabling a corresponding reduction in the size of the beam deflection hokes, leading to cost savings in both material and power consumption. However, reducing neck diameter while maintaining or even increasing display screen area severely taxes the performance limits of the electron gun.

In the conventional in-line electron gun design, an electron optical system is formed by applying critically determined voltages to each of a series of spatially positioned apertured electrodes. Each electrode has at least one planar apertured surface oriented normal to the tube's long or Z axis, and containing three side-by-side or "in-line" circular straight-through apertures. The apertures of adjacent electrodes are aligned to allow passage of the three (red, blue and green) electron beams through the gun.

Most such guns are based on a bipotential lens design, in which focusing is achieved in a lensing field provided by two or more electrodes divided into a low voltage portion and a high voltage portion, typically a low voltage focusing electrode ($G_3$) and a high voltage accelerating electrode ($G_4$). The lensing field is formed in the region of beam acceleration, i.e., inside the forward portion of the focusing electrode, in the gap between and forward aperture plane of the focusing electrode and the rearward aperture plane of the accelerating electrode, and inside the rearward portion of the accelerating electrode.

As the gun is made smaller to fit into the so-called "mini-neck" tube, the apertures are also made smaller and as is well known, the focusing or lensing aberrations of the focusing and accelerating electrode apertures are increased, thus degrading the quality of the resultant picture on the display screen.

Various design approaches have been taken to attempt to increase the effective aperture sizes of these lensing electrodes. For example, U.S. Pat. No. 4,275,332, and U.S. patent application Ser. No. 303,751, filed Sept. 21, 1981, describe overlapping lens structures. U.S. patent application Ser. No. 487,347, filed Apr. 21, 1983, describes a lens structure with enlarged apertures surrounded by a raised rim. U.S. patent application Ser. No. 463,791, filed Feb. 4, 1983, describes a "conical field focus" or CFF lens arrangement. Each of these designs is intended to increase effective aperture size in the main lensing electrodes and thus to maintain or even improve gun performance in the new "mini-neck" tubes.

In the CFF arrangement, a large effective aperture size in the focusing and accelerating electrodes is provided by apertures having the shapes of truncated cones or hemispheres. That is, each aperture has a large opening in the aperture plane and a related small opening in the electrode interior. The large openings of both the focusing and accelerating electrodes thus face each other across the gap.

In a preferred CFF embodiment, the effective aperture size of both electrodes is further increased by enlarging the apertures until their large openings overlap. This overlapping eliminates portions of the sidewalls between adjacent apertures, leaving arcuate "saddles" bridging these apertures across the in-line plane.

These saddles create asymmetric lenses having larger diameters in the direction of the in-line plane than in the transverse direction. In the focusing electrode, such asymmetry tends to create beam spots at the screen with severe horizontal elongation. Thus, for optimum performance of the overlapping CFF lens arrangement, the asymmetry in the focusing electrode must be fully compensated, such as by an effectively identical or "balancing" asymmetry in the accelerating electrode.

In practice, the outer apertures of the accelerating electrode are "offset" from the outer apertures of the focusing electrode, that is, spacing between apertures is greater in the accelerating electrode. As is known, such offset beneficially results in convergence of the three electron beams at the screen.

However, such offset also results in a smaller overlap between apertures and consequently shallower saddles in the accelerating electrode than in the focusing electrode. Furthermore, due to the potential difference across the gap, the beams have a higher velocity in, and their paths are less affected for a given saddle depth by the accelerating electrode than the focusing electrode. Thus, the asymmetry in the lensing field of the accelerating electrode is smaller than in the focusing electrode.

It is an object of the present invention to provide an accelerating electrode with overlapping tapered apertures which has a vertical asymmetry sufficient to substantially compensate for or "balance" the horizontal asymmetry of the focusing electrode.

It is a further object of the invention to provide an accelerating electrode with such balancing asymmetry, while still maintaining the offset between outer apertures needed for convergence of the electron beams at the screen.

It is a further object of the invention to provide a modified bipotential lens electron gun structure incorporating focusing and accelerating electrodes with overlapping tapered apertures, and with offset outer apertures in the accelerating electrode, the asymmetrics of which electrodes balance, whereby beam spots at the screen are both well-rounded and converged.

SUMMARY OF THE INVENTION

In accordance with the invention, an accelerating electrode of an in-line electron gun for a CCRT, featuring partially overlapping tapered apertures with large outer openings and smaller related inner openings, is modified by enlarging the apertures to increase the overlap and consequently to increase the depth of the saddles between adjacent apertures, thereby to create a vertical asymmetry sufficient to substantially compensate for the horizontal asymmetry in the lensing field of the focusing electrode.

The electrode apertures are of a three-dimensional surface of revolution (hereinafter called a volumetric configuration), which is substantially truncated, for example, a truncated cone or hemisphere, the axes of symmetry of which are substantially parallel to one another and to the associated path of the electron beam. Each aperture thus has a large generally circular opening in an outer aperture plane of the electrode and a smaller related opening in the interior of the electrode, being separated from the outer opening by sloping sidewalls. A portion of the sidewall of each aperture intersects a portion of the sidewall of an adjacent aperture to form an inwardly-sloping arcuate rounded saddle along the region of the intersection. The resulting structure is derived from the partial overlapping of geometric constructions of the volumetric configurations.

In order to compensate for the lensing field asymmetry caused by the use of overlapping lenses for the focusing electrode, the apertures of the accelerating electrode are enlarged to provide a balancing asymmetry. Specifically, the apertures are enlarged by an amount sufficient to increase the depth of the saddles by about 10 to 20 percent greater than the depth of the saddles in the focusing electrode.

Such electrodes are useful in a bipotential lensing arrangement, in which the forward portion of the focusing electrode and the rear portion of the accelerating electrode are placed in adjacent, facing relationship, in which each defines three partially overlapping, tapered, in-line apertures, a central aperture and two side apertures. In a preferred embodiment, the outer apertures of the accelerating electrode are offset for convergence.

DESCRIPTION OF THE PREFERRED EMBODIMENTS

Figure 1:
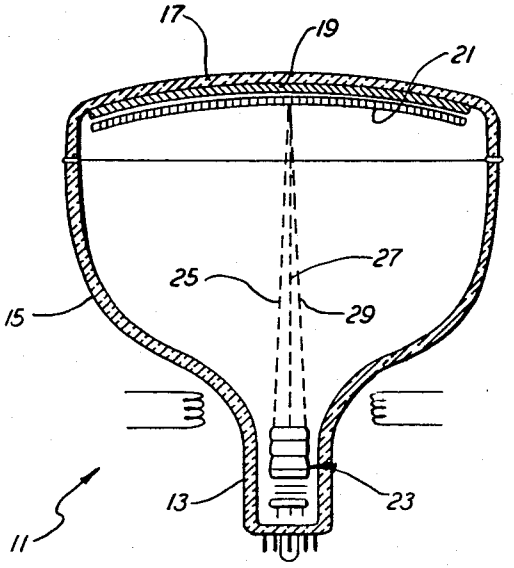
FIG. 1 is a sectioned elevation view of a color cathode ray tube wherein the invention is employed.

With reference to FIG. 1 of the drawings, there is shown a color cathode ray tube (CCRT) of the type employing a plural beam in-line electron gun assembly. The envelope enclosure is comprised of an integration of neck 13, funnel 15 and face panel 17 portions. Disposed on the interior surface of the face panel is a patterned cathodoluminescent screen 19 formed as a repetitive array of color-emitting phosphor components in keeping with the state of the art. A multi-opening structure 21, such as a shadow mask, is positioned within the face panel, spaced from the patterned screen.

Encompassed within the envelope neck portion 13 is a unitized plural beam in-line electron gun assembly 23, comprised of a unitized structure of three side-by-side guns. Emanating therefrom are three separate electron beams 25, 27, and 29 which are directed to pass through mask 21 and land upon screen 19. It is within this electron gun assembly 23 that the structure of the invention resides.

Figure 2:
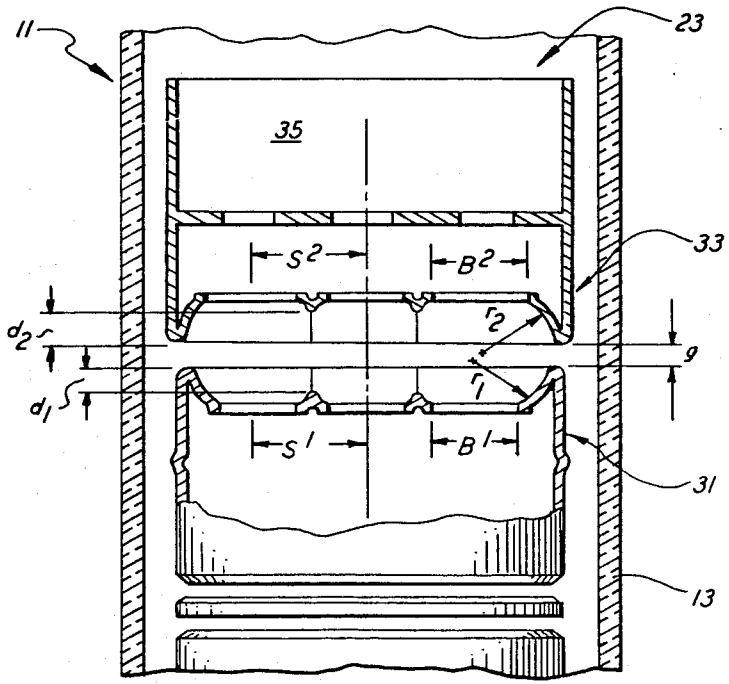
FIG. 2 is a sectioned view of the forward portion of the in-line plural beam electron gun assembly shown in FIG. 1, showing a bipotential lensing arrangement of the invention.

Referring now to FIG. 2, the forward portion of the electron gun 23 of FIG. 1 is shown illustrating a bipotential lensing arrangement of the invention, including a low potential electrode 31, a high potential electrode 33, and a convergence cup 35. Electrode 31 is the final focusing electrode of the gun structure, and electrode 33 is the final accelerating electrode. Together, these two electrodes form the final lensing fields for the electron beams. This is accomplished by cooperation between their adjacent, facing apertured portions to form lensing regions which extend across the inter-electrode space and into the adjacent regions of the focusing and accelerating electrodes. The tapered sidewalls of the apertures enable optimum utilization of the available space inside the tube neck 13. As is known, a slight offset of the outer apertures of the accelerating electrode (33) ($S^2$ greater than $S^1$) results in convergence of the three beams at the screen.

In a "Uni-Bi" gun (sometimes called Quadrapotential Focus, or QPF) typically used in mini-neck CCRT's, the main focusing electrode potential is typically 25 to 35 percent of the final accelerating electrode potential, the inter-electrode spacing g is typically about 0.040 inches (1.02 millimeters), the radius of taper of the apertures is about 0.104 inches (2.63 millimeters) for the focusing electrode and about 0.110 inches (2.795 millimeters) for the accelerating electrode, and the aperture diameters (smaller and larger dimensioned openings) are 0.140 and 0.220 inches (3.56 and 5.59 millimeters) for the focusing electrode and 0.150 and 0.250 inches (3.81 and 6.35 millimeters) for the accelerating electrode. The spacing between aperture centers is 0.177 inch (4.50 millimeter) ($S^1$) for the focusing electrode and 0.182 inch (4.62 millimeter) ($S^2$) for the accelerating electrode.

Figure 3:
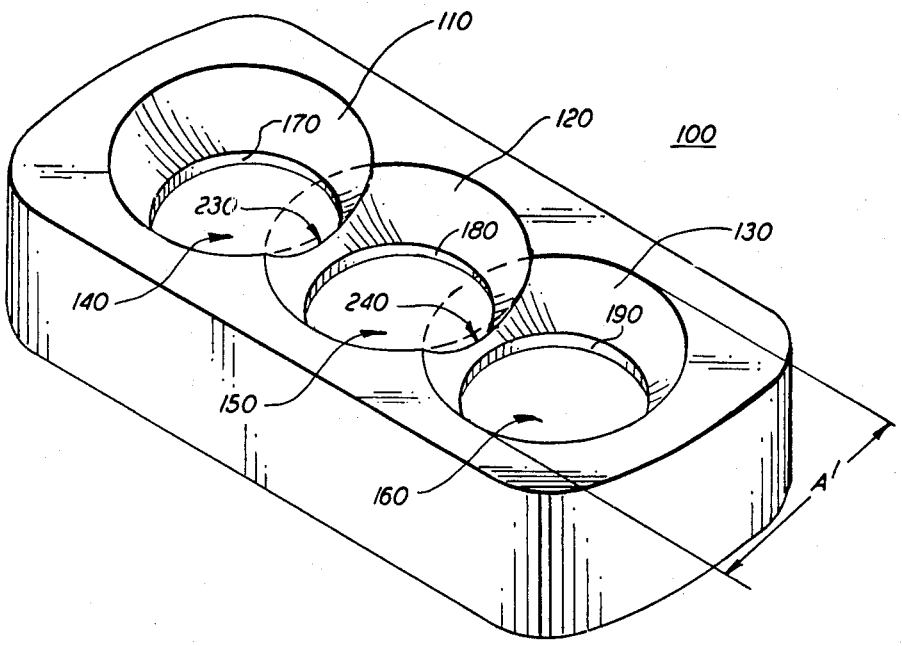
FIG. 3 is a perspective view from above of the unitized high potential lensing electrode of the gun assembly of FIG. 2; affording a partial view of the small openings of the apertures.

Referring now to FIG. 3, there is shown a focusing electrode 100 of the type shown in FIG. 2, having three in-line apertures with large front beam-exiting openings 110, 120 and 130 substantially in the forward planar surface of the electrode, and smaller rear beam-entering openings 140, 150 and 160 in the interior of the electrode, such openings connected by substantially tapered sidewalls terminating with relatively short cylindrical portions 170, 180 and 190. Geometric constructions of the apertures are truncated hemispheres (ignoring cylindrical portions 170, 180 and 190) which partially overlap one another. This overlap is indicated in phanthom in the forward planar surface, and results in the partial removal of sidewall portions of adjacent apertures and the formation of inwardly sloping arcuate edges 230 and 240, termed herein "saddles", resulting in reduced sidewall area between apertures, horizontal asymmetry of the lensing field, and electron beam spots at the screen compressed vertically and elongated horizontally (in the direction of the in-line plane.)

Because of this asymmetry in the focusing electrode, it has been found necessary in accordance with the invention to make the tapered apertures of the accelerating electrode substantially larger than those of the focusing electrode, so that the saddles of the accelerating electrode are as much as 10 to 20% deeper than those of the focusing electrode. With the deeper saddles, the asymmetry of the accelerating electrode then exactly compensates for the asymmetry of the focusing electrode.

An example of the invention is presented for a mini-neck (22 mm neck OD) gun assembly. The main focusing electrode potential is substantially 25 to 35 percent of the final accelerating electrode potential. The inter-electrode spacing g is about 0.040". Electrode dimensions are substantially as follows:

| Dimensions (Millimeters) | Main Focusing Electrode (41) | Final Accelerating Electrode (43) |
|---|---|---|
| Beam Spacings (S) Center-to-Center | $S^1 = 4.5$ | $S^2 = 4.62$ |
| Dia. (A) of Large Openings | $A^1 = 5.21$ | $A^2 = 5.59$ |
| Dia. (B) of Small Openings | $B^1 = 3.55$ | $B^2 = 3.79$ |
| Radius (r) of Sidewall Taper | $r^1 = 2.63$ | $r^2 = 2.795$ |
| Depth (d) of Saddles | $d^1 = 1.168$ | $d^2 = 1.354$ |
| $(d^2 - d^1)/d^1 \times 100 = 15.9\%$ | | |

It is to be understood that the foregoing exemplary dimensions are provided only as an aid to understanding the invention, and are not to be considered limiting.

Use of the described electrodes in a bipotential lensing arrangement which generates the final lensing field provides substantially round and converged beam spot landings at the screen.

While there have been shown and described what are at present considered to be the preferred embodiment of the invention, it will be obvious to those skilled in the art that various changes and modifications may be made therein without departing from the scope of the invention as defined by the appended claims. For example, as is known, convergence can be achieved by means other than the offset between outer apertures of the focusing and accelerating electrodes. In such cases, the depth of the saddles needed for a balancing asymmetry in the accelerating electrode can be achieved with a lesser degree of aperture enlargement than if the offset were present.

What is claimed is:

1. In an in-line electron gun structure for a color cathode ray tube having an in-line plane, a lensing arrangement in the final focusing and accelerating electrodes comprising:

a first lensing structure in the forward portion of the focusing electrode, such structure having three in-line tapered apertures of substantially truncated volumetric configuration having substantially parallel axes of symmetry, each aperture having front beam exits and smaller dimensioned rear beam entrances, the front exits laying in a forward aperture plane and being generally circular and the entrances and exits separated by sloping sidewalls, a portion of the sidewall of each aperture intersecting a portion of an adjacent aperture to form an inwardly sloping arcuate wall along the region of intersection; and a second lensing structure in the rear portion of the final accelerating electrode in adjacent, facing relationship with the first structure, such second structure having three in-line tapered apertures of substantially truncated volumetric configuration having substantially parallel axes of symmetry, each aperture having rear beam entrances and smaller dimensioned front beam exits, the rear entrances lying in a rearward aperture plane and being generally circular and the entrances and exits separated by sloping sidewalls, a portion of the sidewall of each aperture intersecting with a portion of the sidewall of an adjacent aperture to form an inwardly sloping arcuate wall along the region of intersection;

the axes of symmetry of said apertures in said first and second lensing structures lying substantially in the in-line plane;

characterized in that the apertures of the second lensing structure are enlarged, whereby the lensing field asymmetry caused by such enlargement substantially balances the lensing field asymmetry of the first lensing structure.

2. The lensing arrangement of claim 1 wherein the apertures are enlarged to result in a saddle depth of from about 10 to 20 percent greater than the saddle depth of the focusing electrode.

3. The lensing arrangement of claim 2 wherein the saddle depth of the second lensing structure is about 15 percent greater than the saddle depth of the first lensing electrode.

4. The lensing arrangement of claim 1 wherein the space $S_1$, between the axes of symmetry of the center and outer apertures of the first lensing structure is smaller than the space $S_2$ between the axes of symmetry of the center and outer apertures of the second lensing structure.

* * * * *